United States Patent [19]

Smith et al.

[11] 4,195,452

[45] Apr. 1, 1980

[54] GUTTER AND HANGER ARRANGEMENT

[76] Inventors: Truman Smith, 803 E. 13th; Clyde Grayum, 1500 Mitchell, both of Oak Grove, Mo. 64075

[21] Appl. No.: 9,391

[22] Filed: Feb. 2, 1979

[51] Int. Cl.[2] ..... E04D 13/04

[52] U.S. Cl. ..... 52/11; 52/94; 248/48.1

[58] Field of Search ..... 52/11, 12, 15, 16, 530, 52/520; 248/48.1, 48.2, 223.4, 224.2, 73

[56] References Cited

U.S. PATENT DOCUMENTS

| | | | |
|---|---|---|---|
| 1,343,461 | 6/1920 | Marberg | 52/11 |
| 1,706,458 | 3/1929 | Mullen | 248/48.1 |
| 2,843,063 | 7/1958 | Thomson | 52/11 |
| 2,895,694 | 7/1959 | Graving et al. | 248/48.1 |
| 3,057,117 | 10/1962 | Singer | 52/11 |
| 3,098,322 | 7/1963 | Greene | 52/11 |
| 3,333,803 | 8/1967 | Landis | 248/48.2 |
| 3,344,562 | 10/1967 | Miles et al. | 52/11 |
| 3,664,071 | 5/1972 | Gallagher | 52/15 |
| 3,821,512 | 6/1974 | Stanford | 219/213 |
| 3,864,882 | 2/1975 | Lassock | 52/11 |

FOREIGN PATENT DOCUMENTS

| | | | |
|---|---|---|---|
| 195721 | 4/1965 | Sweden | 248/48.1 |

*Primary Examiner*—Alfred C. Perham
*Attorney, Agent, or Firm*—Fishburn, Gold & Litman

[57] ABSTRACT

A gutter and hanger arrangement for a building includes a hanger with a flashing section for anchoring to a roof, a fascia section for overlying a portion of a building vertical wall and a hanger flange joined to the fascia section and having elongate corrugations for slidably attaching a gutter thereto. The gutter includes a bottom wall joined to inner and outer side walls and forming a trough therebetween, the juncture of the bottom wall and the inner side wall comprising an abutment surface for engaging the building vertical wall below the flashing section. The inner side wall is spaced laterally from and extends upwardly of the abutment surface and has a corrugated gutter flange extending generally downwardly in spaced relation to the inner side wall and terminating adjacent the abutment surface to form a passage for sliding the hanger flange longitudinally into interengagement with the gutter flange. The corrugations interlock and inhibit upward movement and disengagement of the gutter from the hanger.

6 Claims, 5 Drawing Figures

FIG 1.
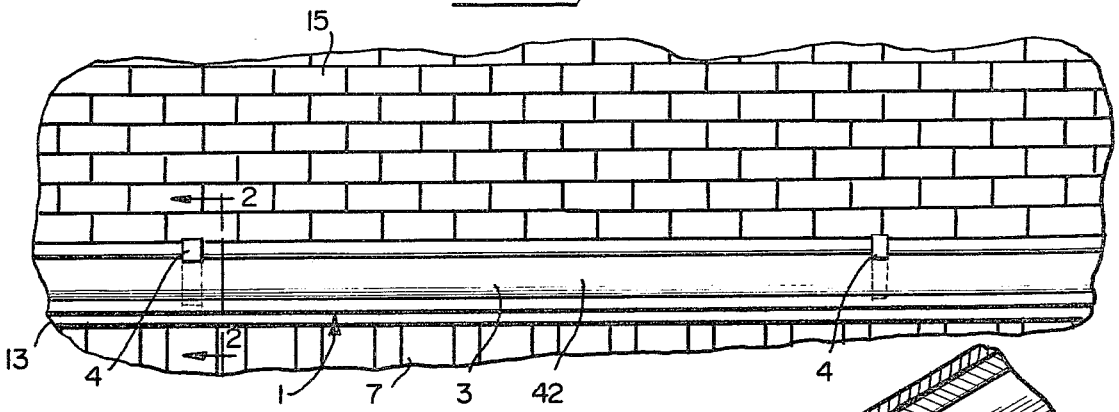
FIG 2.
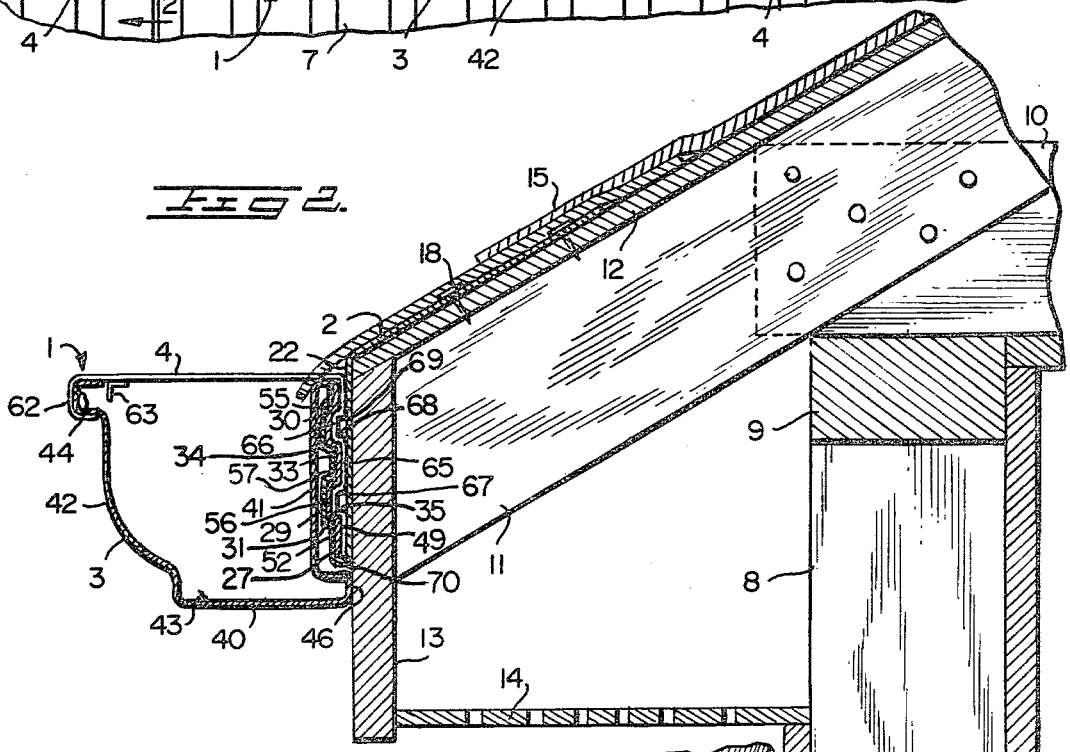
FIG 3.
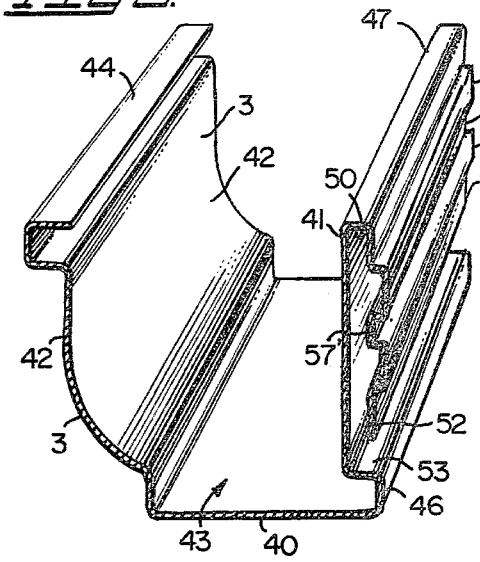
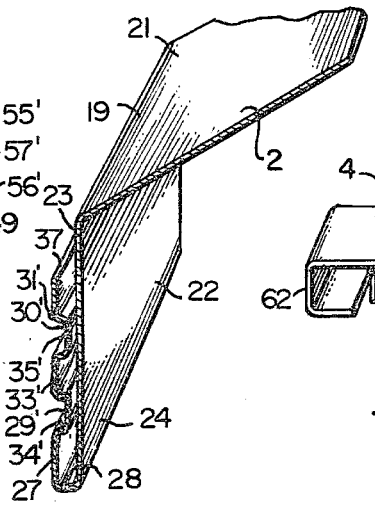
FIG 4.
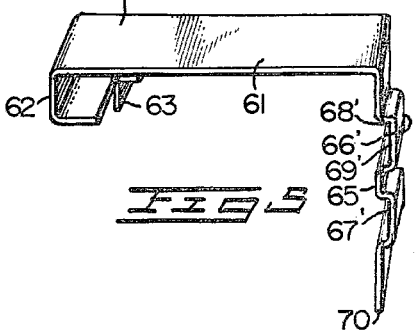
FIG 5

GUTTER AND HANGER ARRANGEMENT

This invention relates to gutters or eaves for directing moisture run off from roofs, and in particular, to a separable roof gutter and hanger arrangement providing sufficient support to inhibit sagging and covering portions of the building vertical wall to inhibit rotting.

Gutters used in present structures are often of a type employing spike and ferrule construction to attach the gutter to a fascia board or plate on the edge of a roof truss. The weight of ice, water-soaked leaves and rotting of the fascia board or plate tends to weaken the attachment of the spikes and cause sagging of the gutter. Further, gutters used in the spike and ferrule construction cannot be practically reattached to the fascia board or plate without relocating the spikes, thereby leaving unsightly holes in the outer side wall of the gutter and leaving holes in the fascia board or plate for ingress of moisture.

It is often desirable to remove the gutters from the building in order to mend or clean same and with conventional spike and ferrule construction, this is a difficult and tedious task often requiring two people working in coordination.

Separable gutter and hanger arrangements known in the art overcome problems associated with spike and ferrule construction but some tend to easily come apart as a result of windstorms, blows against or the like. Such gutter and hanger arrangements have relatively shallow channel and flange connections whereby the gutter can be easily lifted off the hanger.

The principal objects of the present invention are: to provide an improved gutter and hanger arrangement in which the gutter is detachable from the hanger for ease of cleaning and replacement; to provide such an arrangement which tends to prevent moisture from collecting between the gutter and vertical wall member of the building; to provide such an arrangement in which the gutter is amply supported and resists sagging and weakening with use; to provide such an arrangement which can be prefabricated into desired lengths and then relatively quickly attached to a building; to provide such an arrangement which overcomes problems attendant to spike and ferrule gutter construction; to provide such an arrangement having a fascia section covering the fascia board or plate of a building and inhibiting rotting thereof; to provide such an arrangement having elongate interlocking corrugations connecting the gutter with the hanger and inhibiting upward disengagement of the gutter from the hanger; and to provide such a gutter and hanger arrangement which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

FIG. 1 is a front elevational view of a gutter and hanger arrangement embodying the present invention and shown in connection with the roof of a building.

FIG. 2 is an enlarged, transverse sectional view of the gutter and hanger arrangement taken along lines 2—2, FIG. 1 and showing a preferred arrangement of interlocking corrugations thereof.

FIG. 3 is a sectional, perspective view of the gutter and showing an alternative arrangement of corrugations thereof.

FIG. 4 is a sectional, perspective view of a hanger and showing an alternative arrangement of corrugations thereof.

FIG. 5 is a perspective view of a support bracket for connection between the gutter and the hanger and showing an alternative arrangement of corrugations thereof.

Referring to the drawings in more detail:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates a gutter and hanger arrangement embodying the present invention. The arrangement 1 includes a hanger 2, FIG. 4 which is connected to a roof edge as described below. A gutter 3, FIG. 3, and the hanger 2 have respective interlocking corrugations which slidably engage for suspending the gutter 3 in abutment to the roof edge. A plurality of support brackets 4 are positioned at intervals along the length of the gutter 3 and inhibit outward bending or sagging.

In the illustrated example, the gutter and hanger arrangement 1 is connected to a building having an outside wall 7 formed, for example, by a vertical stud 8 capped by a top plate 9 for supporting a rafter 10. A truss 11 is connected to the rafter 10 and roof sheathing 12 is laid across a plurality of trusses 11, and shingles 15 nailed to the sheathing 12. A fascia board or plate 13 is nailed to aligned ends of the trusses 11 to form a longitudinally extending, vertical wall. A soffit return 14 conceals the truss overhang.

The gutter and hanger arrangement 1 is fabricated of a suitable lightweight, easily formed material such as galvanized steel, aluminum, copper, fiberglas or plastic and is preferably formed of a plurality of creases or bends creating panel sections having an angular relation to each other and comprising the respective portions and members set forth below and described in up, down, front and rear orientation relative to the roof and building vertical wall.

The hanger 2 includes a flashing section 21, FIG. 4 which when connected to the building, extends upwardly at an angle matching the angle of the roof and is anchored to the roof sheathing 12, FIG. 2, by suitable means such as nails 18 and covered by the shingles 15. The flashing section 21 is preferably planar and has a lower portion 19 merging with a fascia section 22 extending vertically and lying against at least a portion of the vertical wall of the fascia board or plate 13. The fascia section 22 has an upper portion 23 joined to the flashing section 21 and a lower portion 24 merging with a hanger flange 27 that extends upwardly alongside the fascia section 22. The 27 is spaced horizontally from the fascia section 22 and a way 28 is formed at the juncture of the hanger flange 27 and fascia section 22 for slidably receiving a portion of the gutter 3 as described below.

In the illustrated preferred embodiment, FIG. 2, the hanger flange 27 includes lower and upper longitudinally extending corrugations 29 and 30 forming a clip section 31 of the hanger flange 27. The corrugations 29 and 30 are separated by a land portion 33 and each corrugation 29 and 30 includes substantially horizontal spaced upper and lower flange portions 34 and a vertical web portions 35 forming right angular projections extending away from the fascia section 22, FIG. 2. The hanger flange 27 terminates in an upper edge 37 spaced outwardly or forwardly of and below the juncture of the fascia section 22 and the flashing section 17.

The gutter 3 includes a bottom wall 40 joined to inner and outer, or front and rear, side walls 41 and 42, thereby forming a trough 43. An upper edge of the outer side wall 42 forms a longitudinally extending, C-shape member 44 open toward the rear and providing an ornamental edge and a connecting portion for the support bracket 4 as described below. The outer or front side wall 42 curves downward, and in the illustrated example, comprises an ornamental ogee curve. The inner side wall 41 and the bottom wall 40 join to form an abutment surface 46 for engaging the vertical wall of the fascia board or plate 13 below the hanger fascia section 22. The inner side wall 41 extends upwardly and spaced laterally from the abutment surface 46 to an upper portion 47 level with the C-shaped portion 44 and joined to a gutter flange 49 for insertion between the hanger flange 27 and the fascia section 22. A way 50 bounded by the gutter flange 49 and the inner side wall 41 permits insertion and sliding engagement of the hanger flange 27 therealong. The gutter flange 49 extends generally downward alongside the inner side wall 41 and has a lower edge 52 terminating adjacent the abutment surface 46 forming an elongate passage 53 therebetween for sliding the gutter 3 longitudinally onto the hanger 2.

The gutter flange 49 includes upper and lower, longitudinally extending, clip section right angular corrugations 55 and 56 extending inwardly toward the inner side wall 41, in the preferred arrangement, FIG. 2, and separated vertically by a vertical portion defining a groove 57, the corrugations 55 and 56 and groove 57 having horizontal flange portions and vertical web portions corresponding to the dimensions of the hanger flange corrugations 29 and 30 and land portion 33 for interlocking engagement.

The support bracket 4 comprises of a relatively narrow transverse arm 61 having a front clip portion 62 C-shaped to accord with the gutter C-shaped section 44 for interlocking engagment. A right angle bracket 63 is connected, as by welding, to the underside of the transverse arm 61 for limiting inward movement of the C-shaped member 44. A support bracket flange 65 extends normally from the opposite end of the transverse arm 61 and is configured in accord with the gutter flange 49 and the hanger flange 27 for interlocking engagement therewith. The support bracket flange 65 has upper and lower corrugations 66 and 67 extending toward the hanger flange 27 when engaged therewith, as shown in the preferred arrangement thereof, FIG. 2. Horizontal and vertical support bracket flange portions 68 and 69 have greater dimension than corresponding portions of the gutter flange corrugations 55 and 56 and the hanger flange corrugations 29 and 30 for longitudinal sliding engagement therewith in interlocking relation. At a lower extremity, the flange 65 has a bottom edge 70 which slides along the way 28.

To assemble the present invention, either relatively short lengths or a length matching the length of the building of the hanger 2 is connected to the building roof as described above and shingles or the like roof covering secured over the flashing section 17. Preferably, the shingles 15 extend downwardly and cover the area of connection between the gutter 3 and hanger 2, as shown in FIG. 2, to direct water runoff into the trough 43 of the gutter 3. An elongate section of the gutter 3 is engaged with the hanger 2 by inserting the gutter flange 49 between the hanger flange 27 and fascia section 22 with the corresponding corrugations 29, 30, 55 and 56 interengaging, thereby inhibiting the gutter 3 from upward movement and disengagement from the hanger 2. A plurality of sections of gutter 3 are positioned along the hanger 2 until the desired length is reached.

Support brackets 4 are slid onto the top of the gutter 3 by engaging the front clip portion 62 with the C-shaped member 44 and inserting the support bracket flange 65 between the gutter flange 49 and the fascia section 22 in interengagement therewith, thereby also inhibiting the support bracket 4 from upward movement and disengagement. A plurality of support brackets 4 are preferably individually spaced at five to six foot intervals along the length of the gutter 3 to support the outer side wall 42 against outward bowing as would be caused by the weight of accumulated water soaked leaves or ice in the gutter 3. Moreover, the bracket 63 on the arm 61 resists inward bending of the outer side wall 42 toward the inner side wall 41 such as would be caused by the weight of ladders thereagainst or the like.

It will be apparent that gutter end caps and downspouts (not shown) can be connected to the gutter 3 as desired.

To remove the gutter 3 from the hanger 2 for cleaning, replacement or the like, the gutter 3 is pulled longitudinally from the hanger 2 and thereby disengaged. It will be appreciated that the interengaging corrugations inhibit upward movement and disengagement of the gutter 3 from the hanger 2, such as could occur from blows thereagainst, wind storms or the like.

An alternative arrangement of the interlocking corrugations is shown in FIGS. 3 through 5 wherein the corrugations are reversed in orientation from those shown in connection with FIG. 2, said reversed corrugations and portions thereof being indicated by the same numerals as shown in FIG. 2 with the exception that the numerals of the alternative arrangement corrugations are primed.

In FIG. 3, alternatively arranged gutter flange corrugations 55′ and 56′ are spaced by a groove portion 57′ and extend away from the inner side wall 41.

Correspondingly, in FIG. 4, the hanger flange 27 has alternatively arranged lower and upper corrugations 29′ and 30′ spaced by a planar portion 33′. Horizontal corrugation flange portions 34′ extend toward the fascia section 22 and are connected by a web portion 35′.

Further, alternately arranged support bracket corrugations 66′ and 67′, have vertical portions 69′ and horizontal flange corrugation portions 68′, FIG. 5, which extend toward the fascia section 22 when engaged therewith.

The gutter and hanger arrangement having the alternative arrangement of interlocking corrugations is assembled in the same manner as is the preferred arrangement, FIG. 2.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A gutter and hanger structure comprising:

(a) an elongated roof gutter having a bottom wall and inner and outer side walls forming a trough therebetween, said inner wall having an upper edge portion and a flange connected thereto and extending downwardly in spaced relation to said inner wall;

(b) an elongated hanger member having a fascia wall with upper and lower portions and a flange connected to said lower portion and extending upwardly in spaced relation to said fascia wall;

(c) means connected to said fascia wall for securing same to a building adjacent a roof edge;

(d) said flange on the inner side wall of the gutter extending between and in contact with the flange and fascia wall of the hanger member, said gutter flange and hanger flange having longitudinally extending interlocking longitudinally slideable corrugations for securing the gutter to the hanger member and inhibiting relative upward movement of the gutter.

2. The gutter and hanger arrangement set forth in claim 1 wherein:

(a) said gutter flange and said hanger flange each have upper and lower interlocking corrugations;

(b) each of said corrugations include upper and lower horizontal flange portions and a vertical web portion arranged in right angular relation whereby the horizontal flange portions of each of said gutter flange corrugations engage with the horizontal flange portions of each of said hanger flange corrugations.

3. The gutter and hanger arrangement set forth in claim 2 including:

(a) an abutment surface positioned between said bottom wall and said inner side wall of the gutter and extending outwardly of said inner side wall for engagement with a building vertical wall adjacent said roof; and (b) said gutter flange terminating upward of and spaced from said abutment surface for forming an opening for sliding said hanger flange between said inner side wall and said gutter flange.

4. The gutter and hanger arrangement set forth in claim 1 and including:

(a) a gutter support member having a transverse arm extending between said inner and outer side walls of said gutter and maintaining said outer side wall spaced from said inner side wall;

(b) said arm having opposite end portions, one end portion being connected to said outer side wall and the other end portion having a support member flange depending therefrom and extending between said gutter flange and said hanger fascia wall; and (c) said support member flange having corrugations protruding therefrom and longitudinally slidably engaged with said corrugations of the gutter flange.

5. The gutter and hanger arrangement set forth in claim 4 wherein:

(a) said one end of the transverse arm has a bracket mounted thereon and including spaced, depending legs engaging said outer side wall therebetween and resisting movement of said outer side wall toward and away from said inner side wall.

6. A roof gutter and hanger arrangement comprising:

(a) an elongate hanger having a plurality of longitudinal bends forming panel sections with angular relation to each other and including:

(1) a flashing section extending upwardly for anchoring to a roof adjacent a roof edge;

(2) a fascia section for depending from the roof edge along a building vertical wall and having an upper portion joined to the flashing section and a lower portion spaced therefrom;

(3) a hanger flange connected to the lower portion of the fascia section and extending upwardly alongside the fascia section and spaced from the building vertical wall, the hanger flange having upper and lower generally horizontal flange portions with a web portion therebetween forming a gutter interlocking, longitudinally extending, right angular corrugation protruding therefrom; and (b) an elongate gutter longitudinally slideably engageable with said hanger including a bottom wall joined to inner and outer side walls forming a trough therebetween, the juncture of the inner side wall and the bottom surface having an abutment surface extending from the inner side wall toward said building vertical wall for engagement therewith below the roof edge and the fascia section, the inner side wall having a gutter flange connected thereto and extending alongside in spaced relation for sliding between said hanger flange and said fascia section, the gutter flange terminating short of said abutment surface and having upper and lower generally horizontal flange portions with a web portion therebetween forming a hanger interlocking, longitudinally extending, right angular corrugation protruding therefrom and sized for mutual engagement with said corrugation on said gutter flange whereby said gutter is removably connectible to said hanger and said interlocking corrugations inhibit upward disengaging movement of said gutter from said hanger.

* * * * *